US005954145A

United States Patent [19]

Hesse et al.

[11] Patent Number: 5,954,145

[45] Date of Patent: Sep. 21, 1999

[54] REVERSIBLE PERCUSSION PISTON DRILL APPARATUS

[75] Inventors: Alfons Hesse; Gerhard Balve; Franz-Josef Püttmann, all of Lennestadt, Germany

[73] Assignee: Tracto-Technik Paul Schmidt Spezialmaschinen, Lennestadt, Germany

[21] Appl. No.: 08/841,040

[22] Filed: Apr. 29, 1997

[30] Foreign Application Priority Data

May 2, 1996 [DE] Germany ..... 196 17 603

[51] Int. Cl.[6] ..... E21B 4/14

[52] U.S. Cl. ..... 175/19; 173/91

[58] Field of Search ..... 175/19; 173/91, 173/212

[56] References Cited

U.S. PATENT DOCUMENTS 4,250,972 2/1981 Schmidt ..... 175/19
5,050,686 9/1991 Jenne ..... 175/19
5,056,608 10/1991 Hemmings ..... 175/19
5,172,771 12/1992 Wilson ..... 173/91

FOREIGN PATENT DOCUMENTS 0 484 839 5/1992 European Pat. Off. .

*Primary Examiner*—Hoang C. Dang
*Attorney, Agent, or Firm*—Merchant & Gould P.C.

[57] ABSTRACT

In a percussion drill apparatus for soil drilling with a percussion piston which is moving to and fro within a housing, a control sleeve is mounted on a control tube which protrudes into the percussion piston chamber, the axial position of which determines the direction of movement of the apparatus. In order to make a reversal of movement possible a reversing chamber is connected with a control air line which runs inside the control tube and an approach chamber is connected by way of a drilling with the interior of a control tube which feeds the operating air into the percussion piston chamber. Consequently the control sleeve is moved into one direction with the aid of the control air and in the other direction with the aid of the operating air.

10 Claims, 2 Drawing Sheets

REVERSIBLE PERCUSSION PISTON DRILL APPARATUS

Figure 1:
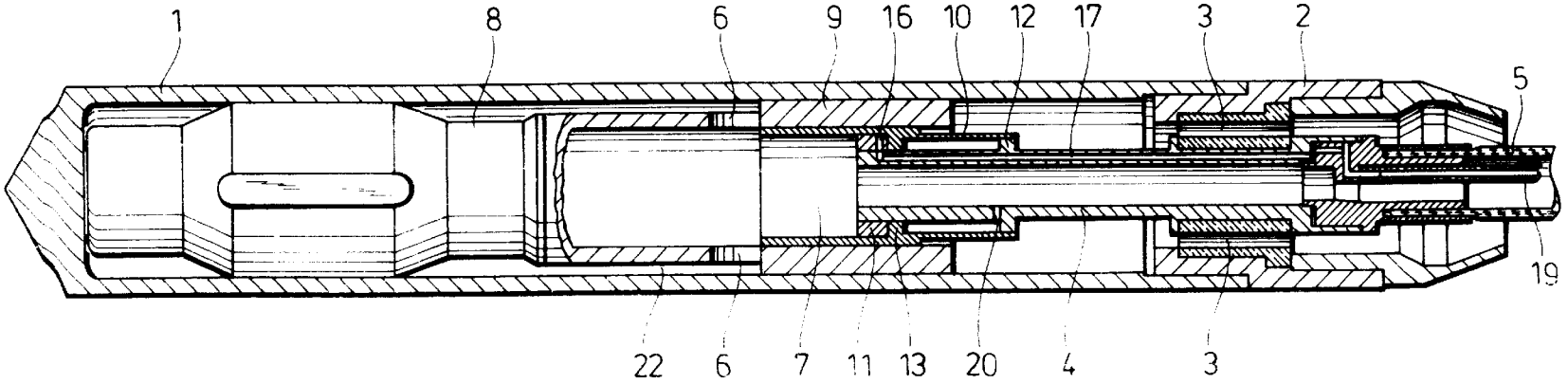

The invention concerns a percussion piston drill apparatus especially for soil drilling without digging and for laying pipelines in the soil.

Such percussion piston drill apparatus are also used for expanding pilot drill holes and for the destructive replacement of existing pipelines in the soil. They have an automatically reversing piston moving inside a housing by means of compressed air, which transfers its kinetic energy in a front dead centre position or in a rear dead centre position onto the housing. In this manner the apparatus can be operated in forward or in reverse motion and can be moved out of the soil in reverse gear when hitting for example an obstacle in the soil or when drilling a dead end borehole.

In order to reverse the apparatus for example from forward to reverse motion, a reversing is required which causes a braking of the percussion piston in a front dead centre position, essentially without transfer of its kinetic energy onto the housing with the aid of the operating air as well as a rearward replacement of the rear dead centre position, which ensures that the percussion piston transfers its kinetic energy, for example, onto an inner rear collar of the housing Such reversals are known in different versions. Thus, there are reversals operated mechanically with the aid of the compressed air hose and pneumatically or spring pneumatically with the aid of the operating air.

From the European publicly distributed printed copy of the application papers 0 484 839 a percussion drill apparatus is already known the pneumatic or spring pneumatic reversal of which does not only operate on the operating air fed in from the percussion piston chamber, but also on the separately admitted control air. In order to make this possible the apparatus has a fixed control tube which is situated in the tail end, which is surrounded by a concentric shorter control air tube, which is also fixed, in such a manner that a ring channel is formed which is connected to a control air line. The ring space between the two tubes is connected, by way of a control air opening, with a reversal chamber between the front part of the control tube and a control box. The control box is attached with its front part to the control tube and with its rear end to the control air tube in a displaceable manner and is brought into the approach position with the aid of the control air, and, after venting of the reversal chamber, is moved into its reverse operating position with the aid of the operating air available in the operating space of the percussion piston. This can be made to happen against the force of a spring installed in the reversal chamber.

In this connection it is a disadvantage that the reversal mechanism consists of three parts, to wit the control tube, the control air tube and the control box. Use of three parts not only requires higher expenditure but also restricts the external diameter of the percussion drill apparatus in a downward direction, because the housing cross section does not only have to hold the percussion piston mantle which surrounds the operating space but also the three concentric tubes as well as the ring channel for the control air and the reversal chamber.

A further disadvantage of the known percussion piston drill apparatus consists in the fact that the control air is fed into the above mentioned ring space between the control tube and the control air tube by way of a separate control air line, which runs beside the operating air hose, through the earth channel created by the percussion piston drill apparatus. Here, damage to the control air hose may occur, particularly in case of greater channel lengths, which cause ventilation of the reversal chamber which can cause an undesired reverse stroke right back to the starting pit. Over and above this the dragging along of the control air hose causes additional friction and consequently a loss of energy which increases with the length of the borehole in the soil. Finally, the control air hose is subject to a not negligible friction wear and tear, which increases the operating costs.

A further essential disadvantage is experienced if the percussion piston drill apparatus is connected with a trailing tube, which remains in the soil as a product line. In this case the operating air hose runs through the trailing tube and the control air hose which, in most cases, is provided with at least one coupling, is situated outside the trailing tube. That presupposes a ring space between the trailing tube and the surrounding soil, which is wide enough to accommodate the control air hose with its couplings. This requires a larger outside diameter of the percussion piston drill apparatus than would be required in consideration of the diameter of the trailing tube which normally is in the order of magnitude of 80 to 85% of the diameter of the apparatus, as well as a larger displacement work which corresponds to the larger external diameter with correspondingly greater expenditure of energy. Over and above this there manifest themselves to an increased extent, the already mentioned disadvantages of a separate control air hose, because the ring space between the trailing tube and the surrounding earth leaves less room than is available in case of apparatus without trailing tubes, for the control air and the operating air hoses in the free cross section of the channel.

As the control line runs outside the percussion piston drill apparatus in an unpressurised space, the reversal chamber is ventilated if the control air hose tears or is lightly damaged, so that the apparatus switches automatically to reverse running and reverses moving out of the soil. In the percussion piston drill apparatus the seal consists of a ring seal against the pressurised space. That means that if only one ring seal fails, the machine can no longer be reversed as the control chamber is then under pressure.

Even if the control air hose were to run through a trailing tube, problems would be experienced with the tube cross section, which, in its lower part is not in the position to accommodate two hoses lying side by side with their couplings. In this it must be considered that part of the tube cross section must remain free for the waste air from the percussion piston drill apparatus.

In the known apparatus a pressure spring together with the control air can also act on the control box. It pushes the latter forward into the approach position. In the case of a ventilated control line the control box is pushed toward the rear against the pressure of the spring, by the operating pressure which acts on the front of the control box. However, if it is necessary to reduce the operating pressure, then it can happen that the pressure spring pushes the control box forward again, or the latter flies to and fro so that no reasonable operation is possible.

If the force of the spring is generally reduced, then it can happen that the control box can no longer be pushed forward by the spring and the control air as the latter is too weak when compared to the pressurised operating air acting on the front.

The invention, therefore, is based on the problem of eliminating the above mentioned disadvantages and especially in the design of a percussion piston drill apparatus with a reversal, which operates with few parts and which in the case of leaks of the control air supply guarantees automatic switchover from forward to reverse running.

These requirements are fulfilled by a percussion piston drill apparatus with a percussion piston which slides to and fro in a housing and and a control tube Which protrudes into a percussion piston chamber, in which according to the invention a control sleeve is attached to the control tube and a reversal chamber is connected with a control air line as well as an approach chamber with the control tube. Consequently the reversal chamber is supplied with control air and the approach chamber with operating air, i.e. the control sleeve is displaced in the one direction with the aid of control air and in the other direction with the aid of the operating air.

Preferably, the control sleeve is guided with an internal collar between two external collars of the control tube arranged at a distance from each other. The collars form two ring spaces between the control sleeve and the control tube of which one functions as reversal chamber and the other as approach chamber. In order to make this possible a control air channel can be arranged in the control tube in the area of the one external collar and an operating air drilling in the area of the other external collar.

The control air channel can be connected with a control air line which runs inside the control tube or with a control tube running inside the control tube wall. In both cases a ring space between one trailing tube and the surrounding soil is not required for a control air line, because the control air is fed into the reversal chamber from inside.

The rear part of the control sleeve can have a smaller external diameter than the front part.

In this fashion a step is formed, which cooperates as control edge with the control openings in the percussion piston mantle and the position of which determines the point in time at which the percussion piston reaches its rearward reversal or dead centre position.

Figure 2:
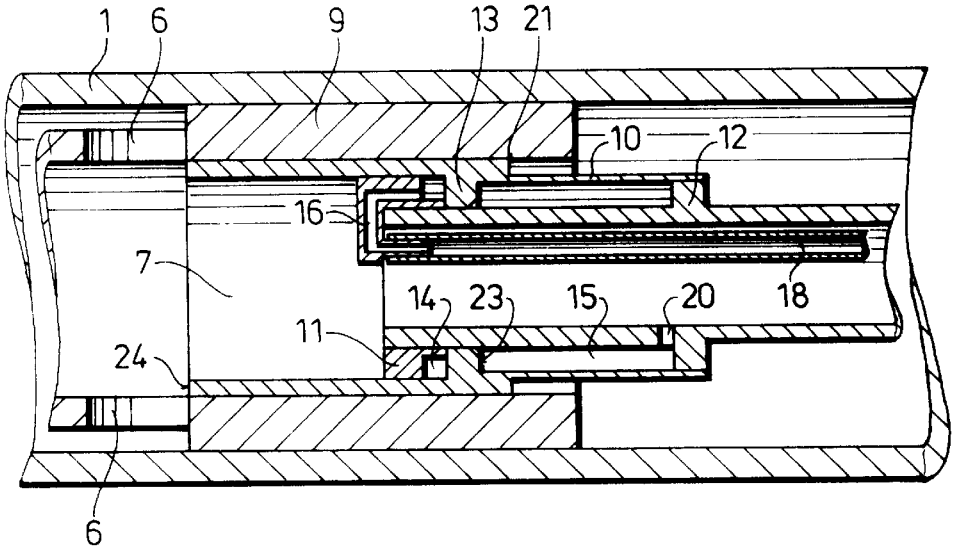
Figure 3:
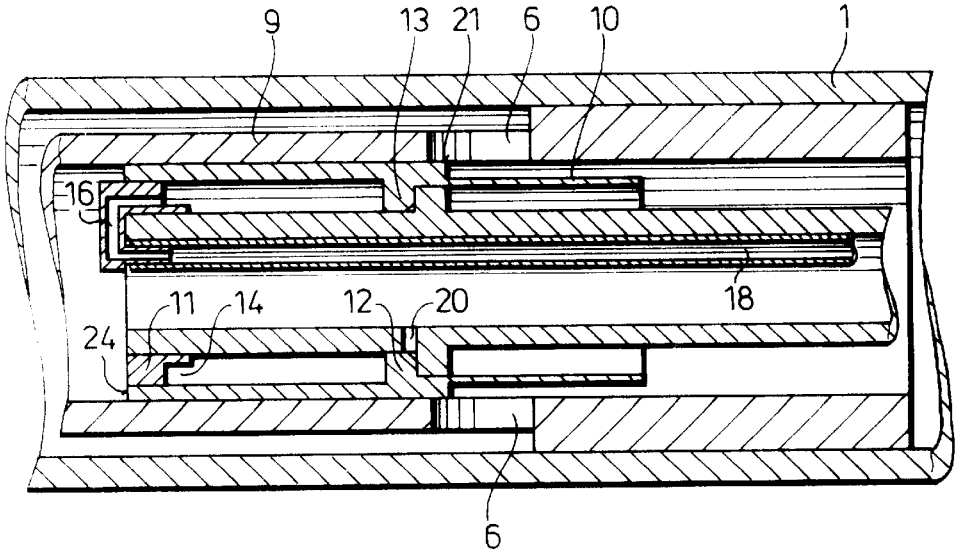

The invention is explained in more detail by means of an example of execution shown in the drawing. In the drawing the following is shown:

FIG. 1 The total view of a percussion piston drill apparatus with a reversal in simplified representation, FIG. 2 a reversal of the percussion piston apparatus with another control air addition of the control sleeve in their approach position and FIG. 3 a representation corresponding to FIG. 2, however with the control sleeve in the reverse position.

The percussion piston drill apparatus, when viewed from the point of view of design and operation, is constructed like the percussion piston drill apparatus described in the German patent specification 21 57 259, the reversal of which is, however, designed differently. It consists of a housing 1, in the rear part of which is arranged a stepped stop ring 2 with waste air channels 3 which are parallel to the axis. In the stop ring 2 there is attached a control tube 4 the rear end of which is attached so that it cannot be rotated or displaced and which is connected with an operating air hose 5. The control tube 4 projects with its front end into a chamber 7 of a percussion piston 8, which is provided with control openings 6.

Between the control tube 4 and the mantle 9 of the percussion piston 8, which surrounds the percussion chamber there is a control sleeve 10 which can move axially, the front part of which is installed on an external collar 11 which is connected with a control tube 4, and the intermediate part is installed on a further external collar 12 of the control tube 4. The control sleeve 10 in its turn has an internal collar 13 arranged between the two external collars 11, 12. All collars are sealed against the relevent sliding faces.

The collars 11, 12, 13 on the one hand delimit a ring shaped reversal chamber 14 and on the other hand an approach chamber 15 which is also ring shaped. Both chambers have a different air supply. Actually the reversal chamber 14 is connected by way of a control air channel 16 inside an adapter part with a control tube channel 17 (FIG. 2, 3) by way of which the reversal chamber 14 is supplied with control air. The control tube channel 17 is connected, in a similar manner as the control air channel 16, with a control air line 19 which is transported along in the interior of the operating air hose 5. Both lines 18, 19 are taken along, protected against wear and tear inside a trailing pipe which is not shown.

Control tube 4 has a radial drilling 20 which opens into the approach chamber 15 by way of which the operating air is supplied to the approach chamber 15.

The control sleeve 10 has a smaller diameter in its rear part than in its front part and consequently a step 21, which permits the operating air to flow off from the operating air space 22, which is situated outside the percussion piston 8, in cooperation with the control drillings 6 through the waste air channels 3.

During the forward run the reversal chamber 14 is ventilated by way of the control air line 18, respectively the control tube channel 17 and the control air line 19 and consequently the control sleeve 10 is under the influence of the operating air which is effective in the approach chamber 15 by way of the drill hole 20 in its front position (FIG. 2).

During the reversal from forward to return run the reversal chamber 14 is supplied with control air by way of the control air line 18 and the control air channel 16, respectively the control tube channel 17 and the control air line 19 and is in this manner transferred to the rear on the control tube 4 into the return run position shown in FIG. 3. There the control sleeve 10 remains until the control air in the reversal chamber 14 is no longer effective. This can happen arbitrarily by switching off the control air and ventilating of the reversal chamber in such a manner that the control air line is brought into connection with the atmosphere by way of an external valve.

However, the reversal according to the invention also permits automatic switching over from forward to reverse run if there is a leak in control line 18, 19, and consequently equalisation of pressure between the control line 18, 19 and the control tube 4 takes place. While, in this case, there is the sane pressure in the reversal chamber 14 and the approach chamber 15, to wit the operating air pressure, the front face 24 of the control sleeve 10, which overall is larger when compared to the pressurised internal collar surface 23, however, brings about that the control sleeve 10 moves automatically into its reverse run position (FIG. 3). This also happens in case of an alteration of the operating pressure, because there is always the same pressure in the chambers 7 and 15. In this manner there is the guarantee that in case of failure of the control air the percussion piston drill apparatus will automatically move backwards out of the borehole produced by it and in this case the apparatus need not be dug out or even abandoned.

The invention guarantees this solely with the aid of control sleeve 10 which is installed directly between the percussion piston mantle 9 and the control tube 4 without spring action and thereby brings about a reversal mechanism which requires a relatively small cross section for its accommodation in the percussion piston chamber 7. To this can be added the comparatively low construction costs as the reversal mechanism requires apart from the control air supply as additional construction part, only the control sleeve when compared to non-reversible percussion piston drill apparatus. The percussion piston drill apparatus according to the invention therefore excels through a high operating reliability and relatively low construction costs.

We claim:

1. A percussion drilling device useful for at least one of production and widening of underground holes, for laying of pipe underground or for destructive replacement of underground piping, comprising:

a housing;

an impact piston movable back and forth within the housing, the impact piston defining an impact piston chamber;

a control pipe connected to the housing and projecting into the impact piston chamber to supply operating air to the impact piston chamber;

a pneumatically slidable control sleeve, comprising an inwardly projecting collar for guiding the control sleeve on the control pipe;

a reversing chamber positioned on a forward side of the inwardly projecting collar with respect to the working direction of the drilling device;

a control air pipe for supplying control air to the reversing chamber; and an advancing chamber positioned on a rearward side of the inwardly projecting collar with respect to the working direction of the drilling device, in fluid communication with the control pipe.

2. A drilling device according to claim 1, wherein the control pipe comprises first and second outwardly projecting collars, the second outwardly projecting collar being positioned forward of the first outwardly projecting collar with respect to the working direction of the drilling device, the inwardly projecting collar being positioned between the first and second outwardly projecting collars.

3. A drilling device according to claim 2, further comprising a control air channel in the area of the second outwardly projecting collar for providing control air from the control air pipe to the reversing chamber, and an opening in the control pipe in the area of the first outwardly projecting collar for communicating with the advancing chamber.

4. A drilling device according to claim 3, wherein the control air pipe is positioned in the control pipe.

5. A drilling device according to claim 3, wherein the control air pipe is defined within a wall of the control pipe.

6. A drilling device according to claim 1, wherein the control sleeve comprises a forward portion and a rearward portion with respect to the working direction of the drilling device, the forward portion having a larger diameter than the rearward portion.

7. A drilling device according to claim 3, wherein the control air channel is defined in an adapter extending from the control pipe to the second outwardly projecting collar.

8. A drilling device according to claim 1, wherein the control air pipe runs within an operating air hose for the drilling device.

9. A drilling device according to claim 1, wherein the control pipe is secured to the housing in a non-slidable and rotationally-fixed manner.

10. A drilling device according to claim 1, wherein the reversing chamber and advancing chamber are further defined by an inner surface of the control sleeve and an outer surface of the control pipe.

* * * * *